US010629143B2

(12) United States Patent
Shan

(10) Patent No.: US 10,629,143 B2
(45) Date of Patent: Apr. 21, 2020

(54) DISPLAY DRIVING METHOD AND DISPLAY APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 254 days.

(21) Appl. No.: 15/751,092

(22) PCT Filed: Dec. 8, 2017

(86) PCT No.: PCT/CN2017/115264

§ 371 (c)(1),
(2) Date: Feb. 7, 2018

(87) PCT Pub. No.: WO2019/071781

PCT Pub. Date: Apr. 18, 2019

(65) Prior Publication Data

US 2020/0020286 A1 Jan. 16, 2020

(30) Foreign Application Priority Data

Oct. 10, 2017 (CN) ..... 2017 1 0935846

(51) Int. Cl.
*G09G 3/36* (2006.01)

(52) U.S. Cl.
CPC ..... *G09G 3/3607* (2013.01); *G09G 2310/027* (2013.01); *G09G 2320/028* (2013.01); *G09G 2320/0233* (2013.01); *G09G 2320/0686* (2013.01)

(58) Field of Classification Search
None
See application file for complete search history.

(56) References Cited

U.S. PATENT DOCUMENTS

| | | | | |
|---|---|---|---|---|
| 8,570,351 | B2 * | 10/2013 | Mori | G09G 3/3607 345/690 |
| 9,805,670 | B2 * | 10/2017 | Kang | G09G 3/2003 |
| 2010/0103206 | A1 * | 4/2010 | Kamada | G09G 3/3607 345/690 |
| 2013/0229430 | A1 * | 9/2013 | Chen | G09G 5/02 345/600 |

* cited by examiner

*Primary Examiner* — Dorothy Harris
(74) *Attorney, Agent, or Firm* — Kagan Binder, PLLC

(57) ABSTRACT

A display driving method includes: acquiring the original light source intensity of each of hues of the content to be displayed and in the preset display area; setting up the driving light source intensity in the display area to be three times of the original light source intensity; acquiring the original gray scale data group of each of pixel units of the content to be displayed and in the preset display area; according to the original gray scale data group of each of pixel units, dividing the original gray scale data group into a first gray scale data group, a second gray scale data group and a third gray scale data group; the gray scale of each of hues in the first gray scale data group is the smallest gray scale, the gray scale of each of hues of the second gray scale data group is the gray scale difference or the common gray scale of the gray scale differences, the third gray scale data group is the difference between the original gray scale data group and a gray scale sum.

18 Claims, 6 Drawing Sheets

DISPLAY DRIVING METHOD AND DISPLAY APPARATUS

CROSS REFERENCE TO RELATED APPLICATION

This application claims priority to Chinese Patent Application No. 201710935846.8, entitled "DRIVING METHOD, APPARATUS AND DEVICE FOR LIQUID CRYSTAL DISPLAY" filed Oct. 10, 2017, the contents of which is expressly incorporated by reference herein in its entirety.

FIELD OF THE INVENTION

The present disclosure relates to the technology field of liquid crystal display (LCD), and particularly relates to a display driving method and a display apparatus.

BACKGROUND OF THE INVENTION

With the continuous development of science and technology, liquid crystal television, liquid crystal displayer and various other LCD devices are increasingly popular and are commonly equipped for residences, shopping malls, office buildings and other places that require information displaying, so as to facilitate the production or life of people.

However, in the color cast change of the side view and front view of various representative color schemes of a prior liquid crystal displayer, the side view color cast of schemes of red, green and blue is more serious over other color schemes, also, due to the fast saturation and escalation of the view angle brightness ratio of gray scale LCD, the front view brightness and side view brightness difference is greater as the gray scale is lower.

SUMMARY OF THE INVENTION

Accordingly, it is necessary to provide a display driving method and display apparatus that can address the problem of the side view color cast.

A display driving method includes:

acquiring original light source intensities of each of hues of a content to be displayed in a preset display area;

setting up the driving light source intensity in the display area to be three times of the original light source intensity;

acquiring original gray scale data group of each of pixel units of the content to be displayed in the preset display area;

dividing the original gray scale data group into a first gray scale data group, a second gray scale data group and a third gray scale data group according to the gray scale data group of each of pixel units; a gray scale of each of hues in the first gray scale data group is a smallest gray scale, a gray scale of each of hues of the second gray scale data group is a gray scale difference or a common gray scale of the gray scale differences, the third gray scale data group is a difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group.

A display apparatus includes a memory, a processor and a computer program stored on the memory and executable on the processor, the processor executes the computer program to provide steps of the foregoing driving method.

A display driving method includes:

acquiring original light source intensities of each of hues of a content to be displayed in a preset display area setting up the driving light source intensity in the display area to be three times of the original light source intensity;

acquiring original gray scale data group of each of pixel units of the content to be displayed in the preset display area;

dividing the original gray scale data group into a first gray scale data group, a second gray scale data group and a third gray scale data group according to the original gray scale data group of each of pixel units; the gray scale of each of hues in the first gray scale data group is the smallest gray scale, the gray scale of each of hues of the second gray scale data group is the gray scale difference or the common gray scale of the gray scale differences, the third gray scale data group is the difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group;

determining an average gray scale in the preset display area according to the original gray scale data group;

acquiring, in the preset display area, a first quantity that a gray scale of hues corresponding to a minimal gray scale in the average gray scale and among the second gray scale data group is 0, and/or a second quantity that a gray scale of hues corresponding to the minimal gray scale in the average gray scale and among the third gray scale data group is 0, and/or a third quantity that a gray scale of hues corresponding to a second minimal gray scale in the average gray scale and among the third gray scale data group is 0;

setting the driving light source intensity of each of the hues corresponding to the minimal gray scale in the preset area to be 0 in displaying the second gray scale data group when the first quantity satisfies a first preset condition; and/or setting the driving light source intensity of each of the hues corresponding to the minimal gray scale in the preset area to be 0 in displaying the third gray scale data group when the second quantity satisfies a second preset condition; and/or setting the driving light source intensity of each of the hues corresponding to the minimal gray scale in the preset area to be 0 in displaying the third gray scale data group when the third quantity satisfies a third preset condition.

According to the display driving method and display apparatus, by dividing the original gray scale data group into a first gray scale data group, a second gray scale data group and a third gray scale data group, i.e., taking the original picture frame signals corresponding to each of pixel units as a multi picture frame combination. And the gray scale of each of hues in the first gray scale data group is the smallest gray scale, the gray scale of each of hues of the second gray scale data group is the gray scale difference or the common gray scale of the gray scale differences, the third gray scale data group is the difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group. As such, in order to highlight the major color and to ameliorate the color cast, the gray scale of each of the hues corresponding to the maximal gray scale in the original gray scale data group is divided into three gray scale data groups less than the maximal gray scale, such that the side view combination brightness of the three gray scale data groups that are less than the maximal gray scale is improved in relation to the original maximal gray scale, the ratio of the viewing angle maximal gray scale major color to the minimal gray scale non-major color brightness is highlighted, so as to reduce the brightness difference of the low gray scale side view sub-pixel hue over the overall pixel hue, such that the side view hue is close to the front view hue presentation.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
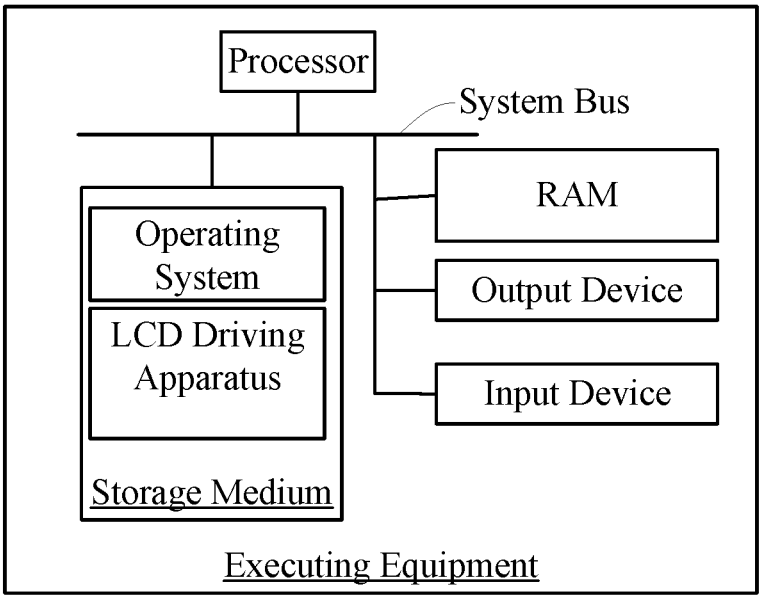
FIG. 1 is a block diagram of an executing device of a display driving method and display apparatus according to an embodiment.

The present disclosure will be described in the following with reference to the accompanying drawings and the embodiments. Preferred embodiments are provided in the drawings. The various embodiments of the disclosure may, however, be embodied in many different forms and should not be construed as limited to the specific embodiments set forth hereinafter. Numerous specific details are described hereinafter in order to facilitate a thorough understanding of the present disclosure.

Unless otherwise defined, the technical and scientific terms used herein have the same meaning to the understanding of a person skilled in the art where the present disclosure pertains. The terms used in the specification of the present disclosure is for the purpose of describing the embodiments of the present disclosure, as opposed to limiting thereto. The language "and/or" used in the disclosure refers to any and all combinations of the one or multiple items listed.

FIG. 1 is a block diagram of an executing device according to an embodiment. The executing device can be a terminal that implements the display driving method. The executing device includes a processor, a storage medium, a Random-Access Memory (RAM), an output device and, an input device connected through the system bus. An operating system and an computer application program of a LCD driving apparatus are stored in the storage medium. When the computer application program of the LCD driving apparatus is executed by the processor, a display driving method is implemented. The processor is configured to provide computation and control capability to support the operation of the executing device. The RAM provides an environment to the computer application program of the LCD driving apparatus in the storage medium, the internal memory has stored computer-readable instructions that, when executed by at least one processors, cause the at least one processor to perform a display driving method. The output device of the executing apparatus can be a display screen, the display screen can be an LCD. The input device can be a touch layer covered on the display screen, a button, a trackball or a touch pad configured on the shell of an electronic device, or an external keyboard, touch pad or mouse and so on. A person skilled in the art should understand, FIG. 1 is exemplary to show the structure of the terminal in accordance with an embodiment of the present disclosure and does not limit the executing apparatus to this embodiment; in other embodiments, compared with the structure shown in FIG. 1, the particular terminal may include more or less components, be configured with other components not shown in FIG. 1, or have a different configuration.

Figure 2:
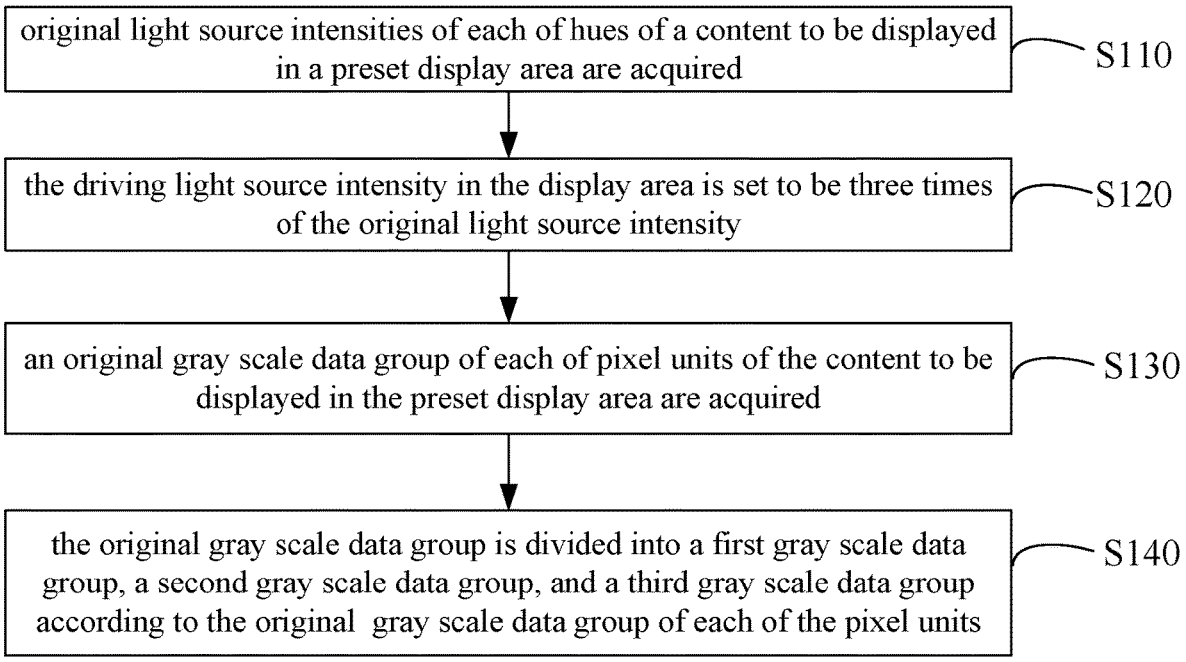
FIG. 2 is a flowchart of a display driving method according to an embodiment.

Referring to FIG. 2, a display driving method is provided, which includes:

In S110: original light source intensities of each of hues of a content to be displayed in a preset display area are acquired.

By a table look-up, original light source intensities of each of hues of the content to be displayed in the preset display area are acquired, i.e., the original light source intensity group in the preset display area and of the content to be displayed are acquired. It should be understood that, the table can be pre-stored in the memory and be called when it is required. The table can also be obtained when it is required, thereby obtaining the original light source intensity group in the preset display area and of the content to be displayed. The light source intensity group of the content to be displayed at column n and row m in the display area can be represented as ($A_{n,\ m_R}$, $A_{n,\ m_G}$, $A_{n,\ m_B}$,).

In S120: the driving light source intensity in the display area is set up to be three times of the original light source intensity.

In the present embodiment, the original gray scale data group of each of pixel units in the preset display area is required to be divided into three gray scale data sub-groups, thus, the driving light source intensity in the preset area is required to be set up to three times of the original light source intensity, so as to compensate the lowered brightness due to the gray scale division. The original light source intensities of each of hues of R, G, B in the preset display area (n, in) are $A_{n,\ m_R}$, $A_{n,\ m_G}$, $A_{n,\ m_B}$, which will be adjusted to driving light source intensity $A'_{n,\ m_R}$, $A'_{n,\ m_G}$, $A'_{n,\ m_B}$, of those, $A'_{n,\ m_R}=3*A'_{n,\ m_R}$, $A'_{n,\ m_G}=3*A'$n, m_G, $A'_{n,\ m_B}=3*A'_{n,\ m_B}$.

In S130: an original gray scale data group of each of pixel units of the content to be displayed in the preset display area is acquired.

The LCD is composed with a plurality of RGB sub-pixel units, each group of RGB sub-pixels is called a pixel unit, each of which represents an image signal. The original gray scale data group of all pixel unit includes a gray scale of R, G, B three colors, for example, ($R_{n,m_i,j}$, $G_{n,m_i,j}$, $B_{n,m_i,j}$) can represent the original gray scale data group of the pixel unit at column i row j in the display area at column n row m. The display region of the LCD can be divided into several display areas, each of which includes at least two pixel units, the size of the display area is customizable, the LCD can be divided into N (columns)*M (rows) display sections composed by pixel units. Various display areas can serve as the preset display areas according to a preset sequence, so as to implement the display driving method.

In S140: the original gray scale data group is divided into a first gray scale data group, a second gray scale data group, and a third gray scale data group according to the original gray scale data group of each of the pixel units. The gray scale of each of the hues in the first gray scale data group is the smallest gray scale, the gray scale of each of the hues of the second gray scale data group is the gray scale differences or the common gray scales of the gray scale differences, the third gray scale data group is the difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group.

According to the display driving method, the original gray scale data group is divided into the first gray scale data group, the second gray scale data group and the third gray scale data group, i.e., taking the original picture frame signals corresponding to each of pixel units as a multi picture frame combination. And the gray scale of each of hues in the first gray scale data group is the smallest gray scale, the gray scale of each of hues of the second gray scale data group is the gray scale differences or the common gray scales of the gray scale differences, the third gray scale data group is the difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group. As such, in order to highlight the major color and to ameliorate the color cast, the gray scale of each of the hues corresponding to the maximal gray scale in the original gray scale data group is divided into three gray scale data groups less than the maximal gray scale, such that the side view combination brightness of the three gray scale data groups that are less than the maximal gray scale is improved with respect to the viewing angle brightness of the original maximal gray scale, the ratio of the viewing angle maximal gray scale major color to the minimal gray scale non-major color brightness is highlighted, so as to reduce the brightness difference of the low gray scale side view sub-pixel hue with respect to the overall pixel hue, such that the side view hue is presented close to the front view hue.

Figure 3:
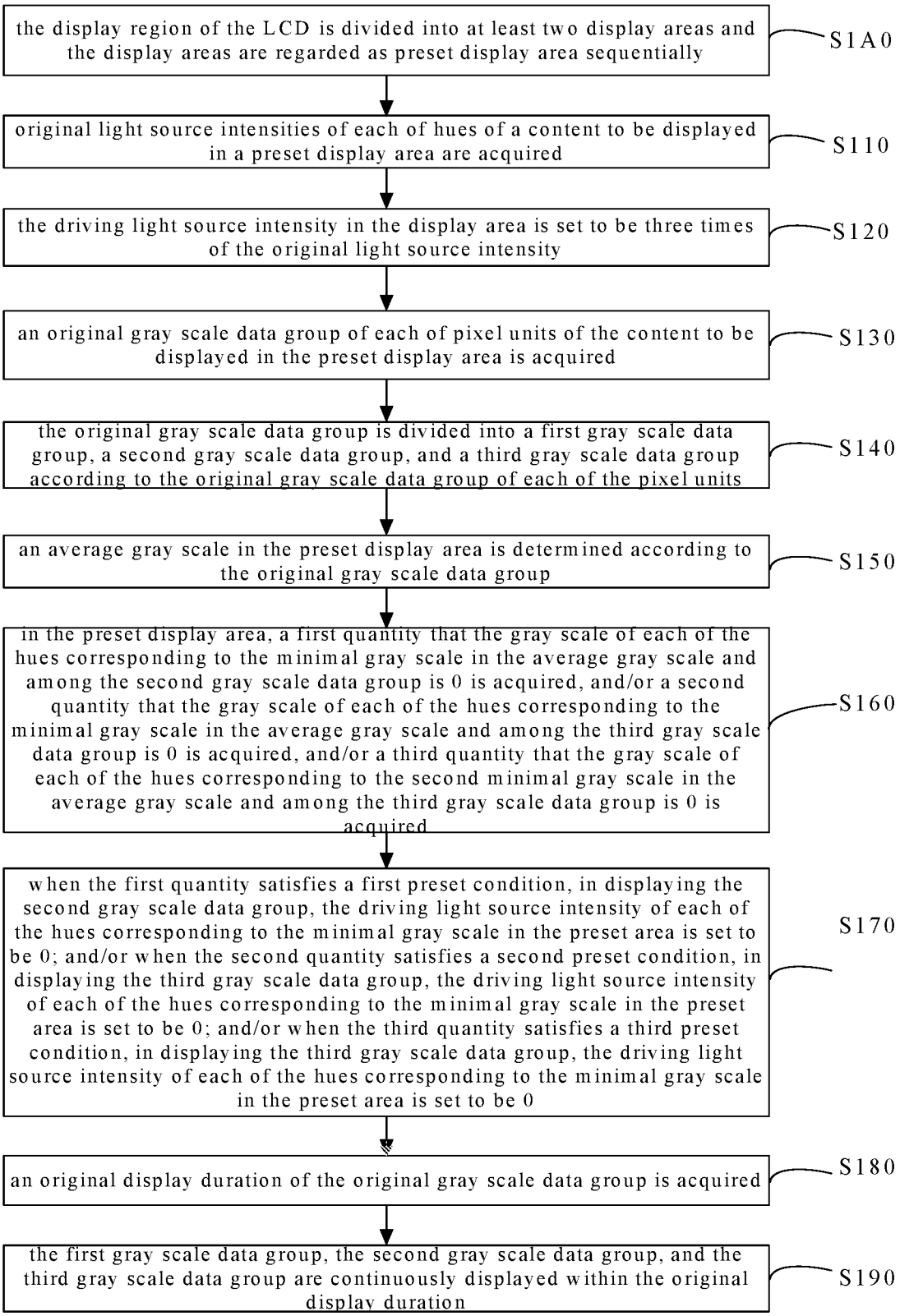
FIG. 3 is a flowchart of a display driving method according to another embodiment.

In order not to affect the display performance greatly while saving the energy. Referring to FIG. 3, in an embodiment, after the original gray scale data group is divided into a first gray scale data group, a second gray scale data group and a third gray scale data group, i.e., after step S140, the method further includes:

In 150: an average gray scale in the preset display area is determined according to the original gray scale data group.

An average gray scale of each of the hues in the preset display area can be determined according to the original gray scale data groups of each of pixel units in the preset display area. By respectively summing up each of hues of the original gray scale data groups in each of pixel units and then dividing by the number of pixel units in the preset display area, the average gray scale of each of the hues in the preset display area is obtained, which is the average gray scale group in the preset display area. For example, ($Ave_R_{n,m}$, $Ave_G_{n,m}$, $Ave_B_{n,m}$) can be used to represent the average gray scale group of the display area at column n and row m.

In S160: in the preset display area, a first quantity that the gray scale of each of the hues corresponding to the minimal gray scale in the average gray scale and among the second gray scale data group is 0 is acquired, and/or a second quantity that the gray scale of each of the hues corresponding to the minimal gray scale in the average gray scale and among the third gray scale data group is 0 is acquired, and/or a third quantity that the gray scale of each of the hues corresponding to the second minimal gray scale in the average gray scale and among the third gray scale data group is 0 is acquired.

In 170: when the first quantity satisfies a first preset condition, in displaying the second gray scale data group, the driving light source intensity of the hue corresponding to the minimal gray scale in the preset area is set to be 0; and/or when the second quantity satisfies a second preset condition, in displaying the third gray scale data group, the driving light source intensity of the hue corresponding to the minimal gray scale in the preset area is set to be 0; and/or when the third quantity satisfies a third preset condition, in displaying the third gray scale data group, the driving light source intensity of the hue corresponding to the minimal gray scale in the preset area is set to be 0.

It should be understood that, in the present embodiment, a driving light source intensity that is not set to be 0 is still set up to be three times of the original light source intensity.

When the brightness ratio of the hue corresponding to the minimal gray scale in the average gray scale and among the second gray scale data group in the preset display area is less than a first preset value, the gray scale of each of the hues corresponding to the minimal gray scale in the average gray scale and among the second gray scale data group in the preset display area is 0. The first preset value can be a customized minimal threshold value of the gray scale that requires compensation, i.e., when a brightness ratio of a hue is no less than the first preset value, it can be determined that the gray scale of each of the hues is not 0; when the brightness ratio is less than the preset value, it is determined that the gray scale of each of the hues is 0.

When the brightness ratio of the hue corresponding to the minimal gray scale in the average gray scale and among the third gray scale data group in the preset display area is less than a second preset value, the gray scale of the hue corresponding to the minimal gray scale in the average gray scale and among the third gray scale data group in the preset display area is 0. The second preset value can be a customized minimal threshold value of the gray scale that require compensation, i.e., when a brightness ratio of a hue is no less than the second preset value, it can be determined that the gray scale of the hue is not 0, when the brightness ratio is less than the preset value, it is determined that the gray scale of the hue is 0.

When the brightness ratio of the hue corresponding to the minimal gray scale in the average gray scale and among the third gray scale data group in the preset display area is less than a third preset value, the gray scale of the hue corresponding to the second minimal gray scale in the average gray scale and among the third gray scale data group in the preset display area is 0. The second preset value can be a customized minimal threshold value of the gray scale that require compensation, i.e., when a brightness ratio of a hue is no less than the third preset value, it can be determined that the gray scale of the hue is not 0; when the brightness ratio is less than the preset value, it is determined that the gray scale of the hue is 0.

The first quantity includes: a first maximal in-array quantity and/or a first maximal quantity. The first maximal in-array quantity is the quantity of pixel unit that the gray scale of each of the hues corresponding to the minimal gray scale in the average gray scale and among the second gray scale data group in the preset matrix in the preset display area is 0. The first maximal total quantity is the quantity of pixel unit that the gray scale of each of the hues corresponding to the minimal gray scale in the average gray scale and among the second gray scale data group in the preset display area is 0. The preset matrix is a matrix block composed by k*k continuous pixel units, where k is less than the row numbers and column numbers of the preset display area and can be customized.

The second quantity includes: a second maximal in-array quantity and/or a second maximal quantity. The second maximal in-array quantity is the quantity of pixel unit that the gray scale of each of the hues corresponding to the minimal gray scale in the average gray scale and among the third gray scale data group in the preset matrix in the preset display area is 0. The second maximal total quantity is the quantity of pixel unit that the gray scale of each of the hues corresponding to the minimal gray scale in the average gray scale and among the third gray scale data group in the preset display area is 0.

The third quantity includes: a third maximal in-array quantity and/or a third maximal quantity. The third maximal in-array quantity is the quantity of pixel unit that the gray scale of each of the hues corresponding to the second minimal gray scale in the average gray scale and among the third gray scale data group in the preset matrix in the preset display area is 0. The second maximal total quantity is the quantity of pixel unit that the gray scale of each of the hues corresponding to the minimal gray scale in the average gray scale and among the third gray scale data group in the preset display area is 0.

The first preset condition includes: the ratio of the first maximal in-array quantity to the quantity of pixel unit in the preset matrix is greater than a first preset ratio; and/or the ratio of the first maximal total quantity to the quantity of pixel unit in the preset display area is greater than a second preset ratio. The first preset ratio is a minimal preset ratio, when the ratio of the first maximal in-array quantity to the quantity of pixel unit in the preset matrix is no greater than the minimal ratio, it indicates that the first quantity is relatively small, and it is not necessary to set the driving light source intensity of the hue corresponding to the minimal gray scale in the preset area to be 0 when the second gray scale data group is to be displayed. When the ratio of the first maximal in-array quantity to the quantity of pixel unit in the preset matrix is greater than the minimal ratio, it indicates that the first quantity is relatively large, the driving light source intensity of the hue corresponding to the minimal gray scale in the preset area is set to be 0 when the second gray scale data group is to be displayed, such that the overall display performance is not greatly affected while saving the energy. The second preset ratio is similar to the first preset ratio, description thereof is omitted for brevity.

The second preset condition includes: the ratio of the second maximal in-array quantity to the quantity of pixel unit in the preset matrix is greater than a third preset ratio; and/or the ratio of the second maximal total quantity to the quantity of pixel unit in the preset display area is greater than a forth preset ratio. The third and fourth preset ratios are similar to the first and second preset ratio, description thereof is omitted for brevity.

The third preset condition includes: the ratio of the third maximal in-array quantity to the quantity of pixel unit in the preset matrix is greater than a fifth preset ratio; and/or the ratio of the third maximal total quantity to the quantity of pixel unit in the preset display area is greater than a sixth preset ratio. The fifth and sixth preset ratios are similar to the first and second preset ratio, description thereof is omitted for brevity.

In a specific example, as there are two embodiments as follow and of each of the pixel units in the preset display area, it is therefore required to, according to the foregoing embodiment, set the driving light source intensity of the preset hue in the preset display area to be 0 when the second and third gray scale data groups are to be displayed.

EXAMPLE ONE

The average gray scales of each of hues in a preset display area are: $Ave_R_{n,m}=A$, $Ave_G_{n,m}=B$ and $Ave_B_{n,m}=C$, respectively, where A>B>C, which belongs to a red hue combination. When there are pixel units having different sizes and sequences from the average gray scales in the preset display area, such as the gray scales of each of hues in the original gray scale data groups of a pixel unit are $R_{i,j}=A2$, $G_{i,j}=B2$, $B_{i,j}=C2$, it is a green hue combination that B2>C2>A2. When the original gray scale data group is divided into three gray scale data group, which are the first gray scale data group ($R1_{i,j}$, $G1_{i,j}$, $B1_{i,j}$), the second gray scale data group ($R2_{i,j}$, $G2_{i,j}$, $B2_{i,j}$), and the third gray scale data group ($R3_{i,j}$, $G3_{i,j}$, $B3_{i,j}$). The first, second, and third gray scale data groups satisfy that $R1_{i,j}+R2_{i,j}+R3_{i,j}=R_{i,j}$ $G1_{i,j}+G2_{i,j}+G3_{i,j}=G_{i,j}$ and $B1_{i,j}+B2_{i,j}+B3_{i,j}=B_{i,j}$. $R1_{i,j}$, $G1_{i,j}$ and $B1_{i,j}$ are all minimal gray scales $R_{i,j}$ that adopt the pixel unit original gray scale data group, i.e., $R1_{i,j}=A2$, $G1_{i,j}=A2$ and $B1_{i,j}=A2$. The gray scales of the each of hues of the second gray scale data group are the gray scale differences or the common gray scales of the gray scale differences between the original gray scale data group ($R_{i,j}$, $G_{i,j}$, $B_{i,j}$) and the first gray scale data group ($R1_{i,j}=A2$, $G1_{i,j}=A2$, $B1_{i,j}=A2$). It should be noted that when the gray scale difference is 0, the gray scale of the hue is 0; when the gray scale difference is not 0, the gray scale of the hue is a common gray scale of the gray scale difference that is not 0; the common gray scale is a shared portion of two gray scale differences, i.e., equivalent to the relatively smaller one among various non-zero gray scale differences. That is $R2_{i,j}=0$, $G2_{i,j}=C2-A2$ and $B2_{i,j}=C2-A2$. The third gray scale data group are the differences between the original gray scale data group and the gray scale data sum, that is $R2_{i,j}=0$, $G2_{i,j}=C2-A2$ and $B2_{i,j}=C2-A2$.

EXAMPLE TWO

Assuming that the average gray scales of each of hues in a preset display area are: $Ave_R_{n,m}=A$, $Ave_G_{n,m}=B$ and $Ave_B_{n,m}=C$, the preset display area is a red hue combination where A>B>C. As such, most of the pixel units in the preset display area satisfy that $R_{i,j}>G_{i,j}>B_{i,j}$. For example, an original data group corresponding to a pixel unit is ($R_{i,j}=A1$, $G_{i,j}=B1$, $B_{i,j}=C1$), where A1>B1>C1, the minimal gray scale in the original gray scale data group is C1, thus the gray scales of each of hues of the divided first gray scale pixel group are C1; the gray scales of the blue hues in the second gray scale data group are 0. Therefore, when displaying the second gray scale data group, the driving light source intensity of the blue hues in the preset display area is set to be 0, for example, the LED light source of the B hue can be turned off when displaying the second gray scale data group, such that the energy is saved.

Although there are relatively few pixel units in the preset display area that does not satisfy $R_{i,j}>G_{i,j}>B_{i,j}$, there must still be a few pixel units with condition 1 where $R_{i,j}$=A2, $G_{i,j}$=B2, $B_{i,j}$=C2, where B2>C2>A2. In such a case, the $B2_{i,j}$=C2−A2 gray scales in the second gray scale data group cannot be normally represented. Still, it can be predicted that since the average gray scales in the preset display area are: $Ave_R_{n,m}$=A, $Ave_G_{n,m}$=B and $Ave_B_{n,m}$=C, the preset display area is a red hue combination where A>B>C. The size and sequence of gray scales of each of hues of most pixel units are consistent with the size and sequence of the average gray scale, there are relatively few cases in the preset display area that are not in line with the size and sequence. Therefore, the overall color or picture quality is not greatly affected by not presenting a small number of $B2_{i,j}$ gray scales in the pixel unit second gray scale data group.

Likewise, when the third gray scale data group is to be displayed, the driving light source intensity of G, B hues are set to be 0, for example, the LED light source of G, B hues are turned off, such that when the size and sequence of the pixel units in the preset display area is different from that of the average gray scale, the green hue combination in situation 1 where $R_{i,j}$=A2,$G_{i,j}$=B2, $B_{i,j}$=C2 (B2>C2>A2), the $G3_{i,j}$=B2−C2 gray scale of the third gray scale data group cannot be normally presented via the LED light source of G hue. Still, it can be predicted that since the average gray scales in the preset display area are: $Ave_R_{n,m}$=A, $Ave_G_{n,m}$=B and $Ave_B_{n,m}$=C, the preset display area is a red hue combination where A>B>C. The size and sequence of gray scales of each of hues of most pixel units are consistent with the size and sequence of the average gray scale, there are relatively few cases in the preset display area that are not in line with the size and sequence. Therefore, the overall color or picture quality is not greatly affected by not presenting a small number of $G3_{i,j}$ gray scales in the pixel unit third gray scale data group.

Accordingly, the driving light source intensity of hues corresponding to the second and third gray scale data group are set to be 0 according to the foregoing embodiment, i.e., turning off the driving light source to save energy, and driving light source intensity of each of hues are not required to be always maintained at a power consumption situation where it is three times of the original light source intensity.

In an embodiment, after the original gray scale data group is divided into the first gray scale data group, the second gray scale data group, and the third gray scale data group, the method further includes:

In S180: an original display duration of the original gray scale data group is acquired.

In S190: the first gray scale data group, the second gray scale data group, and the third gray scale data group are continuously displayed within the original display duration.

In the present embodiment, the gray scale data group of the original picture frame corresponding to the first pixel unit is divided into a first gray scale data group, a second gray scale data group and a third gray scale data group of three picture frames (a first picture frame, a second picture frame, and a third picture frame) corresponding to the pixel unit. The combination of three picture frames is time-sequentially presented in time, i.e., the first gray scale data group, the second gray scale data group, and the third gray scale data group are displayed sequentially. The original display duration is divided into three time periods, among which the first gray scale data group is displayed in one time period, the second gray scale data group is displayed in another time period, and the third gray scale data group is displayed in a third time period. Preferably, to ensure the display performance, the three time periods are of a same length, i.e., each of which is ⅓ of the original display duration. In the preferable embodiment, it can be implemented by way of increasing the picture frame frequency of the displayer by three times.

In an embodiment, prior to the original gray scale data group of each of pixel units of the content to be displayed and in the preset display area is acquired, and prior to the original light source intensity of each of hues of the content to be displayed and in the preset display area, the method further includes:

S1A0: the display region of the LCD is divided into at least two display areas, and the display areas are regarded as preset display area sequentially.

Various display areas can be sequentially arranged as the preset display areas according to a preset sequence, so as to implement the display driving. The preset sequence can be a sequence where a row sorting is first performed prior to a column sorting, or a sequence where a column sorting is performed prior to a row sorting. As such, the LCD driving is performed to various display areas of the entire LCD, thereby realizing the display driving for the entire LCD.

In an embodiment, the step of dividing the original gray scale data group into the first gray scale data group, the second gray scale data group, and the third gray scale data group according to the original gray scale data group of each of pixel units further includes:

a) the gray scales of each of hues in the first gray scale data group are determined according to the minimal gray scale of the original gray scale data group. That is, the minimal gray scale of the original gray scale data group serves as the gray scale of each of hues in the first gray scale data group.

b) the gray scales of each of hues of the second gray scale data group are determined to be the gray scale differences or the common gray scales of the gray scale differences according to the original gray scale data group and the first gray scale data group; the gray scale differences are the differences of the gray scales of each of the hues between the original gray scale data group and the first gray scale data group. The common gray scale can be the shared portion of the two gray scale differences, which is equal to the smaller one in the gray scale differences.

c) a third gray scale data group is determined according to the original gray scale data group and the gray scale sum; the gray scale sum is the sum of the gray scales of each of the hues in the first gray scale data group and the second gray scale data group.

In the present embodiment, the gray scales of each of hues of the second gray scale data group are the gray scale differences or the common gray scales of the gray scale differences, as such, the gray scales of the two hues that are not 0 and in the second gray scale data group are prevented to be greater than the minimal gray scale among the average gray scales in the preset display area and affecting the display performance after the division, thereby achieving a preferable effect of reducing the brightness differences of each of hues between front view and side view of the low gray scale, and produces a preferable image presentation performance of low color cast display.

As a particular example, when all the gray scales of each of hues in the preset display area are red hue combination that $R_{i,j}$=100, $G_{i,j}$=80, $B_{i,j}$=40, the original gray scale data group of the original picture frame corresponding to a pixel unit (i, j) is divided into a first gray scale data group ($R1_{i,j}$, $G1_{i,j}$, $B1_{i,j}$), a second gray scale data group ($R2_{i,j}$, $G2_{i,j}$, $B2_{i,j}$) and a third gray scale data group ($R3_{i,j}$, $G3_{i,j}$, $B3_{i,j}$) of three picture frames (a first picture frame, a second picture frame and a third picture frame) corresponding to the pixel unit. The gray scales of each of hues in the first gray scale data group are the minimal gray scale in the original gray scale data group, i.e., 40, which is $R1_{i,j}$=40, $G1_{i,j}$=40, $B1_{i,j}$=40. The gray scales of each of the hues in the second gray scale data group are the gray scale differences or the common gray scales of the gray scale differences. As the common gray scale of $R_{i,j}-R1_{i,j}$=60 and $G_{i,j}-G1_{i,j}$=40 is 40, then $R2_{i,j}$=40, $G2_{i,j}$=40, $B2_{i,j}$=0. The gray scales of each of hues of the third gray scale data group are the differences between the original gray scale data group and the gray scales sum, i.e., $R3_{i,j}$=20, $G3_{i,j}$=0, $B3_{i,j}$=0. The original gray scale data group is divided into three gray scale data groups, the three gray scale data groups are time-sequentially presented. That is, the original display duration of the original frame is required to be equally divided into three time periods, where one time period presents the first gray scale data group, another time period presents the second gray scale data group, and a third time period presents the third gray scale data group.

Assuming the brightness ratios of the front view of the original gray scale data group ($R_{i,j}$=100, $G_{i,j}$=80, $B_{i,j}$=40) of a pixel unit to a full gray scale 255 are SR %, LG %, MB %, correspondingly, the side view brightness ratios are SR' %, LG' %, MB' %, where SR>LG>MB and SR'>LG'>MB'. Since the front view and side view brightness ratio difference is greater as the gray scale signal is lower, it can be understood that SR/MB>SR'/MB' and LG/MB>LG'/MB', the color is mixed such that the brightness ratio of the primary brightness signal SR at the front view is greater than that of MB in terms of difference, still, in the case of side view, the brightness ratio of the primary brightness signal SR' is less than that of MB' in terms of difference, the color brightness is reduced as the primary hue color of the front view is affected. In view of the optical-electrical characteristics of prior VA displays, the brightness variation corresponding to a standard signal is a relation conforming to an exponent 2.2. For example, Y=(X/255)2.2, Y is a normalization brightness, X is a gray scale (a preferred gray scale is a 8 bit signal between 0 and 255), by way of a table look-up or that the brightness variation corresponding to the above signal is a relation conforming to the exponent 2.2, it can be determined that SR %=13.3%, LG %=7.4%, MB=1.7%, SR' %=39%, LG' %=34.7%, MB'=23.1%.

As all the gray scales of the first gray scale data group are 40, by way of a table look-up, it can be determined that the front view brightness ratios of each of hues of the first picture frame are respectively: 1.8%, 1.8%, 1.8%, and the side view brightness ratios are respectively: 17%, 17%, 17%. As to the second gray scale data group ($R2_{i,j}$=40, $G2_{i,j}$=40, $B2_{i,j}$=0), by way of a table look-up, it can be determined that the front view brightness ratios of each of hues of the second picture frame are respectively: 1.8%, 1.8%, 0%, and the side view brightness ratios are respectively: 17%, 17%, 0%. As to the second gray scale data group ($R3_{i,j}$=20, $G3_{i,j}$=0, $B3_{i,j}$=0), by way of a table look-up, it can be determined that the front view brightness ratios of each of hues of the third picture frame are respectively: 0.5%, 0%, 0%, and the side view brightness ratios are respectively: 9%, 0%, 0%.

As the composite brightness ratios of the combination of the side view picture frames 1, 2, 3 on each of hues $R_{i,j}$, $G_{i,j}$, $B_{i,j}$ are respectively 17%+17%+9%=43%, 17%+17%+0%=34%, 17%+0%+0%=17%, while brightness ratios of each of hues of the side view of the original picture frame are respectively 40%, 33%, 17%, accordingly, the dominant hue B, in relation to the ratio of the brightness ratio of B of low gray scale, is increased from 40%/17%=2.35 of the original picture frame to 43%/17%=2.53 of the combined picture frame, such that the side view is relatively close to the presentation of the dominant hue of the front view. It should be noted that, the dominant hue is the hue corresponding to the maximal gray scale in the original gray scale data group corresponding to the pixel unit.

Figure 4:
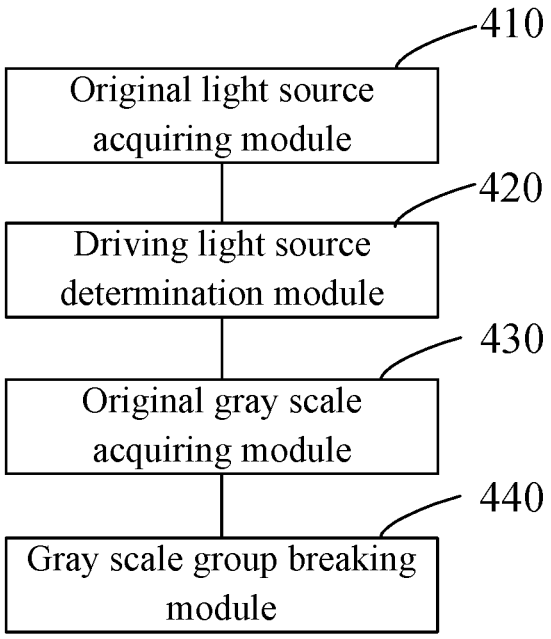
FIG. 4 is a block diagram of a liquid crystal driving device according to another embodiment.

Referring to FIG. 4, an LCD driving apparatus corresponding to foregoing method is also provided herein, which includes:

An original light source acquiring module 410 configured to acquire original light source intensities of each of hues of a content to be displayed in a preset display area;

A driving light source determination module 420 configured to set up the driving light source intensity in the display area to be three times of the original light source intensity;

An original gray scale acquiring module 430 configured to acquire an original gray scale data group of each of pixel units of the content to be displayed in the preset display area;

A gray scale group dividing module 440 configure to, according to the original gray scale data group of each of pixel units, divide the original gray scale data group into a first gray scale data group, a second gray scale data group and a third gray scale data group; the gray scale of each of hues in the first gray scale data group is the smallest gray scale, the gray scale of each of hues of the second gray scale data group is the gray scale difference or the common gray scale of the gray scale differences, the third gray scale data group is the difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group.

According to the LCD driving apparatus, by dividing the original gray scale data group into a first gray scale data group, a second gray scale data group and a third gray scale data group, i.e., taking the original picture frame signals corresponding to each of pixel units as a multi picture frame combination. And the gray scale of each of hues in the first gray scale data group is the smallest gray scale, the gray scale of each of hues of the second gray scale data group is the gray scale difference or the common gray scale of the gray scale differences, the third gray scale data group is the difference between the original gray scale data group and a gray scale sum; the gray scale difference is the difference of the gray scale of each of the hues between the original gray scale data group and the first gray scale data group, and the gray scale sum is the sum of the gray scale of each of the hues in the first gray scale data group and the second gray scale data group. As such, in order to highlight the major color and to ameliorate the color cast, the gray scale of each of the hues corresponding to the maximal gray scale in the original gray scale data group is divided into three gray scale data groups less than the maximal gray scale, such that the side view combination brightness of the three gray scale data groups that are less than the maximal gray scale is improved in relation to the original maximal gray scale, the ratio of the viewing angle maximal gray scale major color to the minimal gray scale non-major color brightness is highlighted, so as to reduce the brightness difference of the low gray scale side view sub-pixel hue over the overall pixel hue, such that the side view hue is close to the front view hue presentation.

Figure 5:
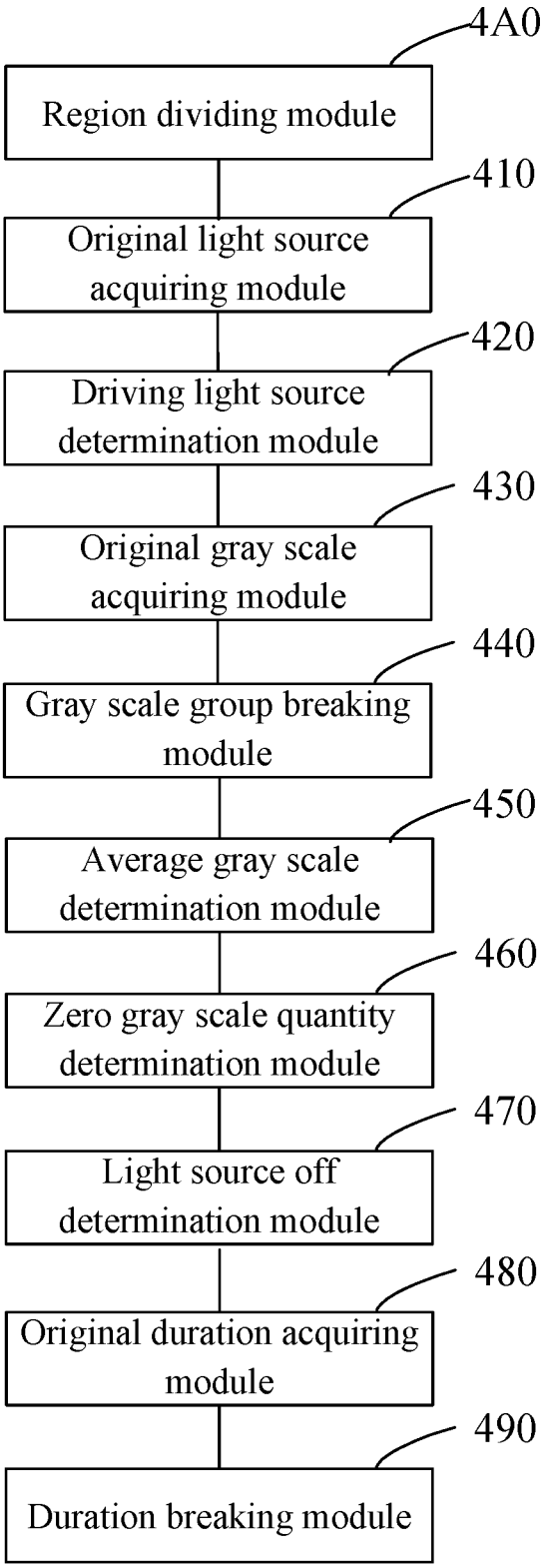
FIG. 5 is a block diagram of a liquid crystal driving device according to another embodiment.

Referring to FIG. 5, in an embodiment, the apparatus further includes:

An average gray scale determination module 450 configured to, according to the original gray scale data group, determine an average gray scale in the preset display area;

A zero gray scale quantity determination module 460 configured to acquire, in the preset display area, a first quantity that the gray scale of the hue corresponding to the minimal gray scale in the average gray scale and among the second gray scale data group is 0, and/or a second quantity that the gray scale of each of the hues corresponding to the minimal gray scale in the average gray scale and among the third gray scale data group is 0, and/or a third quantity that the gray scale of each of the hues corresponding to the second minimal gray scale in the average gray scale and among the third gray scale data group is 0.

A light source off determination module 470 configured to, when the first quantity satisfies a first preset condition, in displaying the second gray scale data group, set the driving light source intensity of the hue corresponding to the minimal gray scale in the preset area to be 0; and/or when the second quantity satisfies a second preset condition, in displaying the third gray scale data group, set the driving light source intensity of the hue corresponding to the minimal gray scale in the preset area to be 0; and/or when the third quantity satisfies a third preset condition, in displaying the third gray scale data group, set the driving light source intensity of the hue corresponding to the minimal gray scale in the preset area to be 0.

Reference to FIG. 5 again, in an embodiment, the apparatus further includes:

An original duration acquiring module 480 configured to acquire an original display duration of the original gray scale data group;

A duration dividing module 490 configured to, within the original display duration, continuously display the first gray scale data group, the second gray scale data group, and the third gray scale data group.

Continue referring to FIG. 5, in an embodiment, further includes:

A region dividing module 4A0 configured to acquire, in the original gray scale acquiring module, the original gray scale data group of each of pixel units of the content to be displayed in the preset display area and to, prior to the original light source intensity of each of hues of the content to be displayed in the preset display are is acquired by the original light source acquiring module, divide the display region of the LCD into at least two display areas and sequentially regard the display areas as the preset display area.

Figure 6:
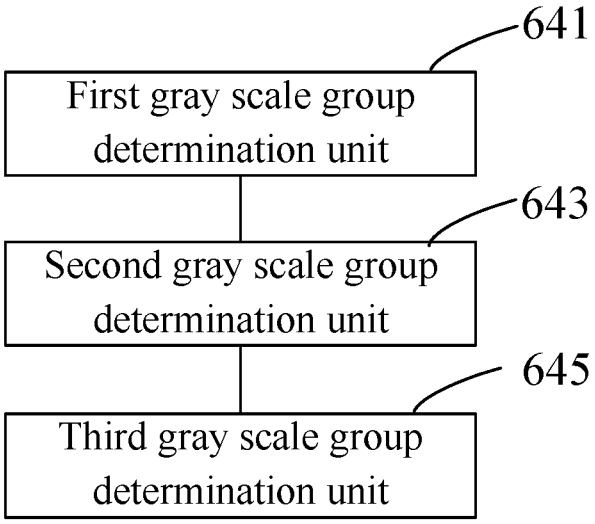
FIG. 6 is a block diagram of a module of a liquid crystal driving device in FIG. 4 or FIG. 5.

Referring to FIG. 6, in an embodiment, the gray scale group dividing module includes:

A first gray scale group determination unit 641 configured to, according to the minimal gray scale of the original gray scale data group, determine the gray scales of each of hues in the first gray scale data group;

A second gray scale group determination unit 643 configured to, according to the original gray scale data group and the first gray scale data group, determine the gray scales of each of hues of the second gray scale data group to be the gray scale differences or the common gray scales of the gray scale differences; the gray scale differences are the differences of the gray scales of each of the hues between the original gray scale data group and the first gray scale data group;

A third gray scale group determination unit 645 configured to, according to the original gray scale data group and the gray scale sum, determine the third gray scale data group; the gray scale sum is the sum of the gray scales of each of the hues in the first gray scale data group and the second gray scale data group.

A display apparatus corresponding to the foregoing method is also provided.

A display apparatus includes a memory, a processor and a computer program stored on the memory and executable on the processor, the processor executes the computer program to provide steps of the foregoing display driving method.

As the foregoing LCD driving apparatus is corresponding to the LCD driving method, with respect to the specific technical features of the apparatus and corresponding to the foregoing method are omitted for brevity.

As the foregoing display apparatus is corresponding to the display driving method, with respect to the specific technical features of the display apparatus and corresponding to the foregoing method are omitted for brevity.

It should be noted that, the display apparatus is, for example, an LCD, an Organic Light-Emitting Diode (OLED) display, an Quantum Dot Light Emitting Diodes (QLED), a Curved surface display or other displays.

The different technical features of the above embodiments can have various combinations which are not described for the purpose of brevity. Nevertheless, to the extent the combining of the different technical features do not conflict with each other, all such combinations must be regarded as being within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A display driving method comprising:

Acquiring an original light source intensity of each of hues of a content to be displayed in a preset display area;

setting up the driving light source intensity in the display area to be three times of the original light source intensity;

acquiring an original gray scale data group of each of pixel units of the content to be displayed in the preset display area; and dividing the original gray scale data group into a first gray scale data group, a second gray scale data group, and a third gray scale data group according to the original gray scale data group of each of the pixel units; wherein a gray scale of each of each of the hues in the first gray scale data group is the smallest gray scale, a gray scale of each of the hues of the second gray scale data group is a gray scale difference or a common gray scale of the gray scale differences, the third gray scale data group is a difference between the original gray scale data group and a gray scale sum; wherein the gray scale difference is a difference of the gray scale of each of the hues between the original gray scale data group and the first gray scale data group, and the gray scale sum is a sum of the gray scale of each of the hues in the first gray scale data group and the second gray scale data group.

2. The method according to claim 1, wherein after dividing the original gray scale data group into the first gray scale data group, the second gray scale data group, and the third gray scale data group, the method further comprises:

determining an average gray scale in the preset display area according to the original gray scale data group;

acquiring, in the preset display area, a first quantity that a gray scale of hues corresponding to a minimal gray scale in the average gray scale and among the second gray scale data group is 0, and/or a second quantity that a gray scale of hues corresponding to the minimal gray scale in the average gray scale and among the third gray scale data group is 0, and/or a third quantity that a gray scale of hues corresponding to a second minimal gray scale in the average gray scale and among the third gray scale data group is 0; and setting the driving light source intensity of each of the hues corresponding to the minimal gray scale in the preset area to be 0 in displaying the second gray scale data group when the first quantity satisfies a first preset condition; and/or setting the driving light source intensity of each of the hues corresponding to the minimal gray scale in the preset area to be 0 in displaying the third gray scale data group when the second quantity satisfies a second preset condition; and/or setting the driving light source intensity of each of the hues corresponding to the minimal gray scale in the preset area to be 0 in displaying the third gray scale data group when the third quantity satisfies a third preset condition.

3. The method according to claim 2, wherein the first quantity comprises a first maximal in-array quantity and/or a first maximal quantity.

4. The method according to claim 3, wherein the first preset condition comprises: a ratio of the first maximal in-array quantity to a quantity of pixel unit in a preset matrix is greater than a first preset ratio; and/or a ratio of the first maximal total quantity to the quantity of pixel unit in the preset display area is greater than a second preset ratio.

5. The method according to claim 2, wherein the second quantity comprises a second maximal in-array quantity and/or a second maximal quantity.

6. The method according to claim 5, wherein the second preset condition comprises a ratio of the second maximal in-array quantity to a quantity of pixel unit in a preset matrix is greater than a third preset ratio; and/or a ratio of the second maximal total quantity to the quantity of pixel unit in the preset display area is greater than a forth preset ratio.

7. The method according to claim 2, wherein the third quantity comprises a third maximal in-array quantity and/or a third maximal quantity.

8. The method according to claim 7, wherein the third preset condition comprises a ratio of the third maximal in-array quantity to a quantity of pixel unit in a preset matrix is greater than a fifth preset ratio; and/or a ratio of the third maximal total quantity to the quantity of pixel unit in the preset display area is greater than a sixth preset ratio.

9. The method according to claim 2, wherein the step of acquiring, in the preset display area, the first quantity that the gray scale of each of the hues corresponding to a minimal gray scale in the average gray scale and among the second gray scale data group is 0 is:

acquiring, in the preset display area, the first quantity that the brightness ratio of each of the hues corresponding to a minimal gray scale in the average gray scale and among the second gray scale data group is less than the first preset value.

10. The method according to claim 2, wherein the step of acquiring, in the preset display area, the second quantity that the gray scale of each of the hues corresponding to the minimal gray scale in the average gray scale and among the third gray scale data group is 0 is:

acquiring, in the preset display area, the second quantity that the brightness ratio of each of the hues corresponding to a minimal gray scale in the average gray scale and among the third gray scale data group is less than the second preset value.

11. The method according to claim 2, wherein the step of acquiring, in the preset display area, the third quantity that the gray scale of each of the hues corresponding to the minimal gray scale in the average gray scale and among the third gray scale data group is 0 is:

acquiring, in the preset display area, the third quantity that the brightness ratio of each of the hues corresponding to a minimal gray scale in the average gray scale and among the third gray scale data group is less than the third preset value.

12. The method according to claim 2, wherein after dividing the original gray scale data group into the first gray scale data group, the second gray scale data group, and the third gray scale data group, the method further comprises:

acquiring an original display duration of the original gray scale data group; and continuously displaying the first gray scale data group, the second gray scale data group, and the third gray scale data group within the original display duration.

13. The method according to claim 12, wherein the display duration of each of the first gray scale data group, the second gray scale data group, and the third gray scale data group is ⅓ of the original display duration.

14. The method according to claim 2, wherein prior to the step of acquiring the original gray scale data group of each of the pixel units of the content to be displayed and in the preset display area, and prior to acquiring the original light source intensities of each of the hues of the content to be displayed and in the preset display area, the method further comprises:

dividing a display region of an LCD into at least two display areas, and regarding the display areas as the preset display area sequentially.

15. The method according to claim 2, wherein the step of dividing the original gray scale data group into the first gray scale data group, the second gray scale data group, and the third gray scale data group according to the original gray scale data group of each of pixel units comprises:

determining the gray scales of each of the hues in the first gray scale data group according to the minimal gray scale of the original gray scale data group;

determining the gray scales of each of the hues of the second gray scale data group to be gray scale differences or common gray scales of the gray scale differences according to the original gray scale data group and the first gray scale data group; wherein the gray scale differences are the differences of the gray scales of each of the hues between the original gray scale data group and the first gray scale data group; and determining the third gray scale data group according to the original gray scale data group and a gray scale sum; wherein the gray scale sum is the sum of the gray scales of each of the hues in the first gray scale data group and the second gray scale data group.

16. The method according to claim 1 wherein the step of acquiring the original gray scale data group of each of the pixel units of the content to be displayed and in the preset display area comprises:

acquiring original light source intensities of each of the hues of a content to be displayed in a preset display area by a table look-up.

17. A display apparatus comprising a memory, a processor and a computer program stored on the memory and executable on the processor, the processor executes the computer program to provide steps of a display driving method of claim 1.

18. A display driving method comprising:

acquiring an original light source intensity of each of hues of a content to be displayed in a preset display area by a table look-up;

setting up the driving light source intensity in the display area to be three times of the original light source intensity;

acquiring original gray scale data group of each of pixel units of the content to be displayed in the preset display area;

dividing the original gray scale data group into a first gray scale data group, a second gray scale data group and a third gray scale data group according to the original gray scale data group of each of the pixel units; wherein a gray scale of each of the hues in the first gray scale data group is the smallest gray scale, a gray scale of each of the hues of the second gray scale data group is a gray scale difference or a common gray scale of the gray scale differences, the third gray scale data group is a difference between the original gray scale data group and a gray scale sum; the gray scale difference is a difference of the gray scale of each of the hues between the original gray scale data group and the first gray scale data group, and the gray scale sum is a sum of the gray scale of each of the hues in the first gray scale data group and the second gray scale data group;

determining an average gray scale in the preset display area according to the original gray scale data group;

acquiring, in the preset display area, a first quantity that a gray scale of hues corresponding to a minimal gray scale in the average gray scale and among the second gray scale data group is 0, and/or a second quantity that a gray scale of hues corresponding to the minimal gray scale in the average gray scale and among the third gray scale data group is 0, and/or a third quantity that a gray scale of hues corresponding to a second minimal gray scale in the average gray scale and among the third gray scale data group is 0; and setting the driving light source intensity of each of the hues corresponding to the minimal gray scale in the preset area to be 0 in displaying the second gray scale data group when the first quantity satisfies a first preset condition; and/or setting the driving light source intensity of each of the hues corresponding to the minimal gray scale in the preset area to be 0 in displaying the third gray scale data group when the second quantity satisfies a second preset condition; and/or setting the driving light source intensity of each of the hues corresponding to the minimal gray scale in the preset area to be 0 in displaying the third gray scale data group when the third quantity satisfies a third preset condition.

* * * * *